US005998935A

United States Patent [19]

Marcotte

[11] Patent Number: 5,998,935

[45] Date of Patent: Dec. 7, 1999

[54] AC PLASMA DISPLAY WITH DUAL DISCHARGE SITES AND CONTRAST ENHANCEMENT BARS

[75] Inventor: Robert G. Marcotte, New Paltz, N.Y.

[73] Assignee: Matsushita Electric Industrial Co., Ltd., Osaka, Japan

[21] Appl. No.: 09/310,553

[22] Filed: May 12, 1999

Related U.S. Application Data

[63] Continuation of application No. 08/939,251, Sep. 29, 1997, Pat. No. 5,852,347.

[51] Int. Cl.[6] ..... G09F 9/00

[52] U.S. Cl. ..... 315/169.4; 313/582; 345/55

[58] Field of Search ..... 345/55, 67, 68; 315/169.1, 169.3, 169.4; 313/582, 583, 584, 585, 586, 587

[56] References Cited

U.S. PATENT DOCUMENTS

| | | | |
|---|---|---|---|
| 3,666,981 | 5/1972 | Lay | 313/190 |
| 4,728,864 | 3/1988 | Dick | 315/169.3 |

OTHER PUBLICATIONS

Proc. of Int'l Display Workshop, 1998, pp. 575–578, D. I. Kim et al., "New AC–PDP Structure with Floating Electrodes".

*Primary Examiner*—David H. Vu

*Attorney, Agent, or Firm*—Ohlandt, Greeley, Ruggiero & Perle

[57] ABSTRACT

An AC PDP incorporating the invention includes a first substrate having plural elongated address electrode structures, which include sets of color phosphors. A second substrate is opposed to the first substrate and encloses a dischargeable gas therebetween. The second substrate supports a plurality of scan loops and sustain loops that are interdigitated with the scan electrode loops. Gas discharges occur at intersections between address electrodes and both traces of a scan loop to which a scan voltage is applied and a single side of each adjacent sustain loop to which a sustain voltage is applied. This action creates wall charges at each of two subpixel sites for each color subpixel. Thereafter, sustain signals applied to sustain and scan electrode loops causes discharges at each of the dual subpixel sites at which wall charges exist. Electrically isolated contrast enhancement bars are placed within scan and sustain electrode loops and act to block ambient light from reflecting off the phosphor layer. Accordingly, ambient room contrast ratio of the PDP is enhanced due to the reduced reflection of the room light off the phosphor. Brightness reduction is minimized by the contrast bars being placed in the center of the loops where light is not produced.

15 Claims, 5 Drawing Sheets

AC PLASMA DISPLAY WITH DUAL DISCHARGE SITES AND CONTRAST ENHANCEMENT BARS

This Application is a Continuation in Part of U.S. patent application Ser. No. 08/939,251, filed Sep. 29, 1997, now U.S. Pat. No. 5,852,347.

FIELD OF THE INVENTION

This invention is related to the front plate electrode design of large area Plasma Display Panels (PDPs) and, more particularly, to an improved large area color AC plasma display panel, which exhibits, improved contrast.

BACKGROUND OF THE INVENTION

Color plasma display panels (PDPs) are well known in the art. FIG. 1 illustrates a first prior art embodiment of an AC color PDP wherein narrow electrodes are employed on the front panel. More particularly, the AC PDP of FIG. 1 includes a front plate with horizontal plural sustain electrodes 10 that are coupled to a sustain bus 12. A plurality of scan electrodes 14 are juxtaposed to sustain electrodes 10, and both electrode sets are covered by a dielectric layer (not shown). A back plate supports vertical barrier ribs 16 and plural vertical column conductors 18 (shown in phantom). The individual column conductors are covered with red, green or blue phosphors, as the case may be, to enable a full color display to be achieved. The front and rear plates are sealed together and the space therebetween is filled with a dischargeable gas.

Pixels are defined by the intersections of (i) an electrode pair comprising a sustain electrode 10 and a juxtaposed scan electrode 14 on the front plate and (ii) three back plate column electrodes 18 for red, green and blue, respectively. Subpixels correspond to individual red, green and blue column electrodes that intersect with the front plate electrode pair.

Subpixels are addressed by applying a combination of pulses to both the front sustain electrodes 10 and scan electrodes 14 and one or more selected column electrodes 18. Each addressed subpixel is then discharged continuously (i.e., sustained) by applying pulses only to the front plate electrode pair. A PDP utilizing a similar front plate electrode structure is shown in U.S. Pat. No. 4,728,864 to Dick.

Some PDPs have used wider transparent electrodes that are connected to a high conductivity feed electrode. Such an electrode structure is shown in FIG. 2 and includes transparent electrodes 20, which are connected to sustain electrodes 10 and scan electrodes 14, respectively. In the configurations of both FIG. 1 and FIG. 2, the gap between the electrodes defines the electrical breakdown characteristic for the PDP. The width of the electrodes affects the pixel capacitance and, therefore, the discharge power requirements. The wider transparent electrodes 20 provide a means to input greater power levels to the PDP for increased brightness. However, the manufacturing cost of transparent electrodes 20 is much greater, due to the increased number of required processing steps.

Optically, the narrow electrode topology of FIG. 1 produces a significant amount of light on the outside of the electrodes, virtually eliminating any dark areas between pixel sites. By contrast, sustain electrodes 10 and scan electrodes 14 at the edges of transparent electrodes 20 create a shading of the light between the pixel sites, resulting in dark horizontal lines between pixel rows.

U.S. Pat. No. 4,772,884 to Weber et al. illustrates a further PDP design wherein plasma spreading or "coupling" is employed to couple the plasma at an address cell to one of a plurality of pixels that are adjacent to the addressed cell. In such a PDP structure, loop-configured address electrodes and sustain electrodes are employed to enable selective control of plasma coupling. A description of other color PDP structures and modes of operation can be found in "Development of Technologies for Large-Area Color AC Plasma Displays", Shinoda et al., SID 93 Digest, pages 161–164.

When a PDP is placed in a well lit room, the ambient room contrast ratio is the ratio of the peak white brightness divided by the display's dark level. The intensity of the dark level is a function of the display's background glow plus the ambient light reflecting off the display. For the viewer, a display with a poor ambient room contrast ratio will appear washed out, whereas, in a dark room, the same display will exhibit vibrant colors.

Ambient room contrast has traditionally been enhanced by placing a filter in front of the display. Room light is filtered as it comes into the display and is filtered again after it is reflected off the front panel. The panel's active light is likewise filtered, however it only passes through the filter once. The transmissivity of commonly used filters is 50 to 75%. A 50% filter reduces the reflected room light by a factor of 4, but also reduces the display's brightness in half.

Several factors contribute to the reflectivity of a display. The front filter typically has an anti-reflective coating to minimize its reflectance. The panel's reflectance is a combination of the reflectivity of the front plate surface, the electrode material's reflectivity, and the phosphor's reflectivity. Of these, the phosphor's reflectivity contributes heavily to the reflectance due to its light color.

There is a continuing need to improve the contrast of color PDPs without reducing brightness.

Accordingly, it is an object of this invention to provide a color PDP that exhibits enhanced contrast.

It is another object of this invention to provide an improved color PDP which wherein reflectance from a phosphor layer is reduced.

SUMMARY OF THE INVENTION

An AC PDP incorporating the invention includes a first substrate having plural elongated address electrode structures, with dielectric layers present thereon and including sets of color phosphors. A second substrate is opposed to the first substrate and encloses a dischargeable gas therebetween. The second substrate supports a plurality of scan electrode structures that are orthogonally oriented to the address electrode structures. Each scan electrode structure includes a scan loop with a first trace and a second trace and a plurality of sustain electrode loops that are interdigitated with the scan electrode loops, each sustain electrode loop including a first trace and a second trace. Address circuitry selectively applies address signals to the address electrode structures and scan circuitry applies a scan voltage to the scan electrode loops. Gas discharges occur at intersections between address electrode structures and both traces of a scan loop to which the scan voltage is applied, so as to create wall charges and dual subpixel sites for each color subpixel. Thereafter, a sustain signal applied to sustain electrode loops causes discharges at each of the dual subpixel sites at which wall charges exist.

Increased light and resolution are the result of the dual subpixel discharge sites. Electrically isolated contrast enhancement bars are placed within dual discharge site scan and sustain electrode loops and act to block room light from reflecting off the phosphor layer. Accordingly, ambient room contrast ratio of the PDP is enhanced due to the reduced reflection of the room light off the phosphor. Brightness reduction is minimized by the contrast bars being placed in the center of the loops where light is not produced. Such a display, exhibiting a contrast ratio improvement, allows use of front filters with higher levels of light transmission, while meeting an ambient room contrast ratio specification. Since the display only has a small reduction of brightness, the overall brightness of the monitor (i.e., PDP and filter) increases significantly. For applications requiring higher contrast ratios, a lower transmission filter may be used in conjunction with the invention. Further improvements may be gained through use of polarized filters and oxidized metallizations.

DETAILED DESCRIPTION OF THE INVENTION

Dual Discharge Site/Enhanced Brightness PDP

Figure 1:
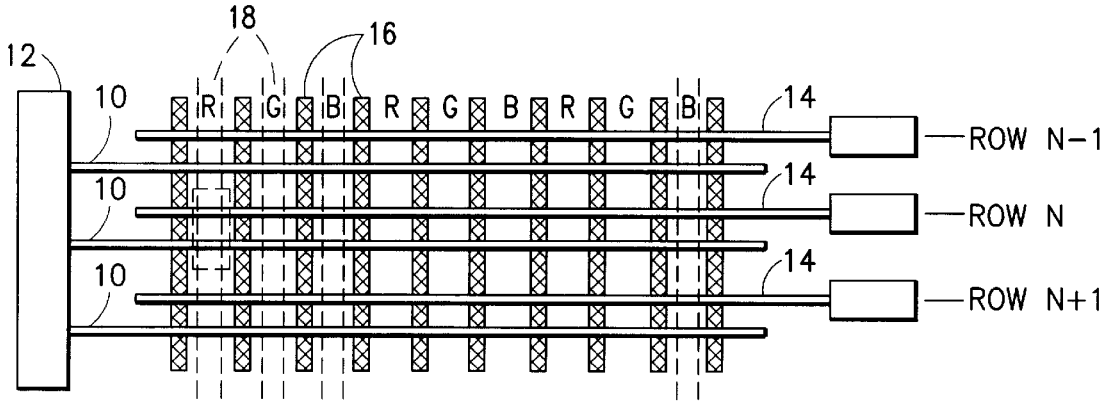
FIG.1 PRIOR ART
FIG. 1 is a schematic diagram of a prior art color PDP using narrow, scan and sustain electrodes.
Figure 2:
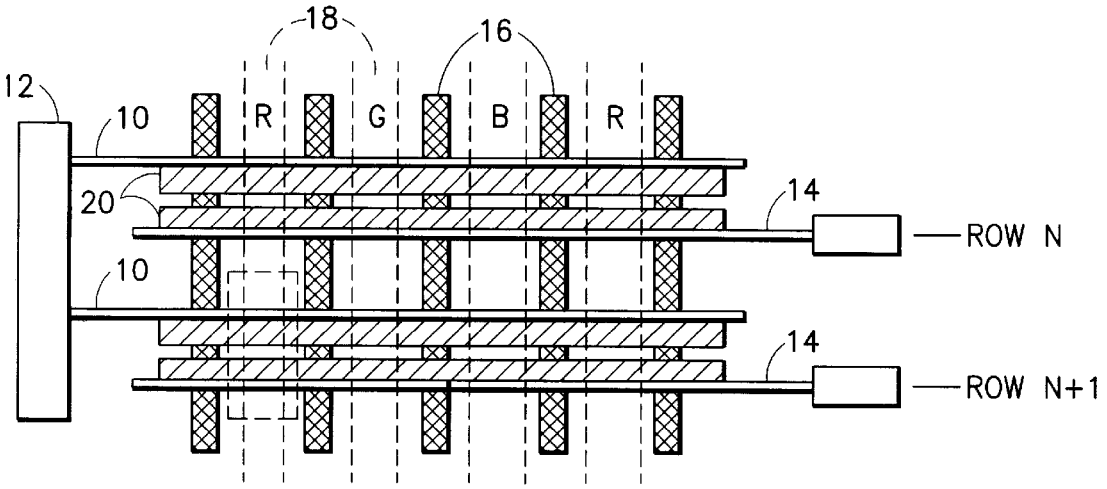
FIG.2 PRIOR ART
FIG. 2 is a schematic diagram of a prior art PDP structure which employs transparent electrodes.

The invention to be described below builds upon the narrow electrode topology shown in FIG. 1, but extends that technology to larger area displays by configuring the narrow electrodes as loops. Such loops enable creation of dual discharge sites at each addressed subpixel, thereby enhancing the brightness and resolution of the resulting display and, further, improving the manufacturability of the PDP.

Figure 3:
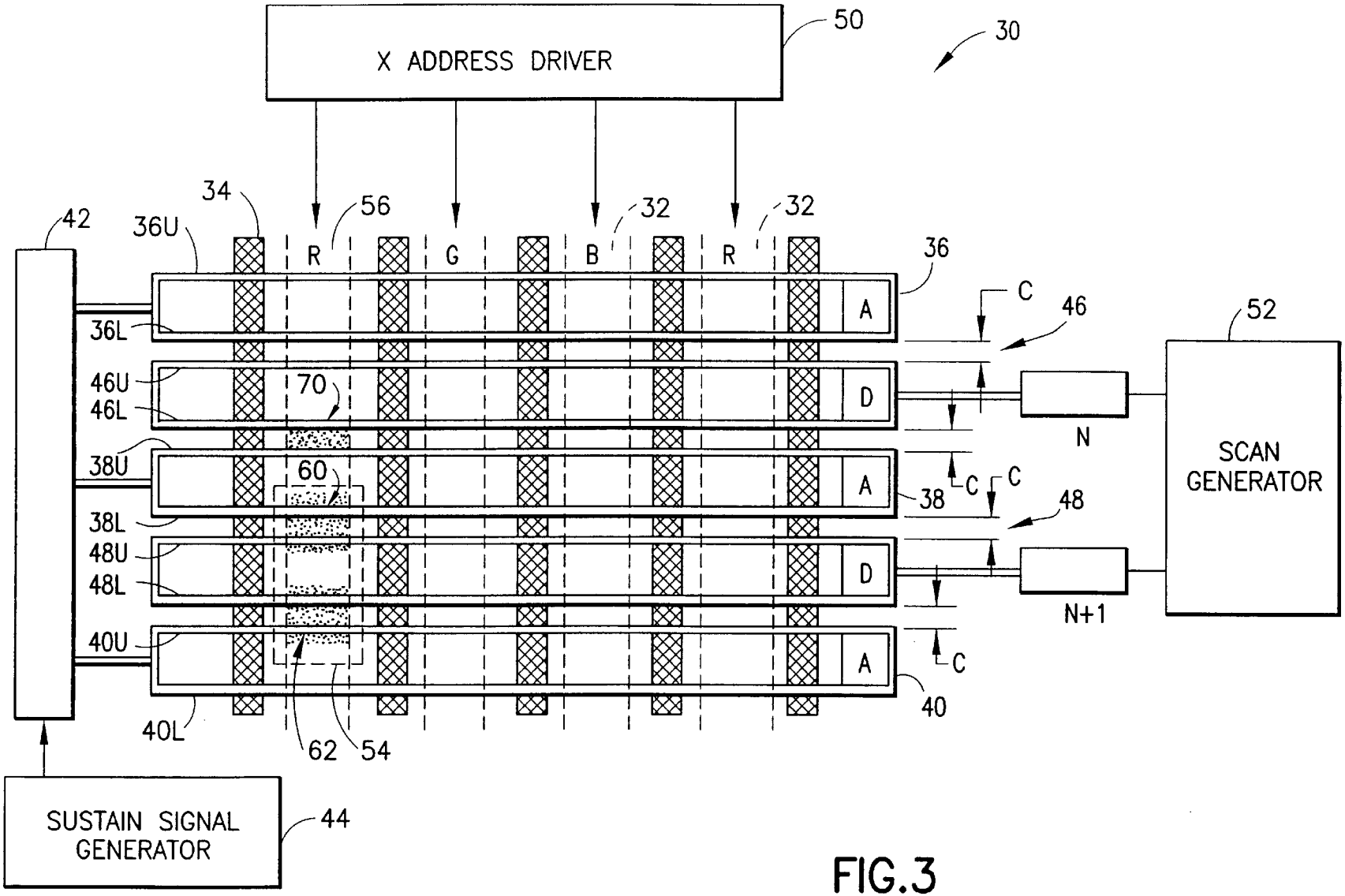
FIG. 3 is a schematic diagram of a PDP that incorporates dual discharge sites.

Referring to FIG. 3, a PDP 30 which incorporates dual discharge sites, includes a rear panel (not shown) on which column electrodes 32 are positioned. Column electrodes 32 are respectively covered by red, green and blue phosphors. Each column electrode 32 is separated from each other column electrode 32 by a dielectric rib 34, which extends upwardly from the rear plate. A transparent front plate (not shown) supports a plurality of sustain loops 36, 38, 40, . . . etc., each sustain loop having an upper trace 36U, 38U, 40U . . . etc. and a lower trace 36L, 38L, 40L . . . etc. Each of sustain loops 36, 38 and 40 is coupled to a sustain bus 42 which, in turn, is connected to a sustain signal generator 44.

Scan loops 46, 48, . . . etc. are interdigitated between respective sustain loops 36, 38, 40 . . . etc. Thus, scan loop 46 is positioned between sustain loops 36 and 38 and scan loop 48 is positioned between sustain loops 38 and 40. Each scan loop includes an upper trace electrode (46U, 48U) and a lower trace electrode (46L and 48L).

To selectively address a subpixel site (at time T1 in FIG. 4), X address driver 50 selectively applies a column drive voltage to one or more column electrodes 32, while scan generator 52 sequentially scans each of scan electrodes 46, 48, etc. Assuming that a subpixel 54 is to be addressed (shown in phantom), X address driver 50 applies a column drive voltage to a column conductor 56. When scan generator 52 applies a row select voltage (FIG. 4) to scan loop 48, a discharge is created between both upper trace electrode 48U, lower trace electrode 48L and column conductor 56. This discharge spreads and discharges the wall capacitances of sustain electrodes 38L and 40U. As a result, a wall charge is established at discharge sites 60 and 62 (substantially immediately below trace electrodes 38L, 48U and 48L, 40U) on the dielectric layers which cover those trace electrodes.

Subsequently at time t2 in FIG. 4, a sustain potential is applied to scan loops 46 and 48. Under such condition, the wall charges between trace electrodes 38L and 48U at site 60 and 48L and 40U at site 62, in cooperation with the applied sustain potential, causes two independent discharges to occur at sites 60 and 62. Accordingly, each addressed subpixel includes dual discharging sites. To the viewer, discharging subpixel sites 60 and 62 tend to merge and manifest substantial levels of output illumination.

Certain features of the PDP structure shown in FIG. 3 are important to a properly operating PDP. Dimension C is the gas discharge gap, which defines the two discharge sites on either side of a scan loop. Dimensions A and D are the inter-electrode distances between the traces of a sustain loop and a scan loop, respectively. In order to maintain substantially independent discharges at, for example, discharge site 60 and 62, dimension D must be kept large enough to prevent one discharge site from dominating during a discharge action with a column electrode 56. More specifically, if the traces of a scan loop are positioned too close to each other, then two distinct discharge sites are not achieved. In such case, one site will "hog" the discharge and will snuff out the other one, creating discharge voids during subsequent sustain cycles. Accordingly, the minimum scan loop dimension must be such as to assure substantially independent discharge actions upon application of address and scan potentials to the column electrodes and scan loops, respectively. Assuming a subpixel pitch of approximately 1.3 mm, distance D may preferably be set to approximately: 0.3 mm.

With respect to the sustain loops, dimension A must be set to exceed a minimum distance so as to prevent a discharge at a subpixel site (e.g., 60) from spreading to a discharge site of an adjacent subpixel (e.g., site 70). If dimension A is made too small, a discharge at site 60 will tend to spread across sustain loop 38 and cause an errant discharge at site 70. This will cause enough wall charge to be removed from site 70 that subsequent discharges will either be too weak or become nonexistent. Accordingly, it is preferred, given a pixel pitch of approximately 1.3 mm, that distance A be approximately 0.4 mm or larger.

With each gas discharge occurring across a gap C, the phosphor on the back plate is excited to produce light which is largely emitted through the discharge gap C. However, a significant amount of light is also emitted from the opposite side of the respective upper and lower traces of the sustain and scan loops. Since light is produced on either side of four electrode traces per pixel, the light is seen as three small bright spots and two dimmer fringing spots. From a distance, the light disturbance caused by the shadowing of the electrodes is negligible and the viewer sees a crisp, clear, high resolution image.

An added benefit to the structure shown in FIG. 3 is that, during processing of the front plate, if a void occurs in one of the loop segments, the remainder of the loop is capable of maintaining the electrical integrity of the entire loop. When processing large plates, this can represent a substantial cost savings.

Figure 4:
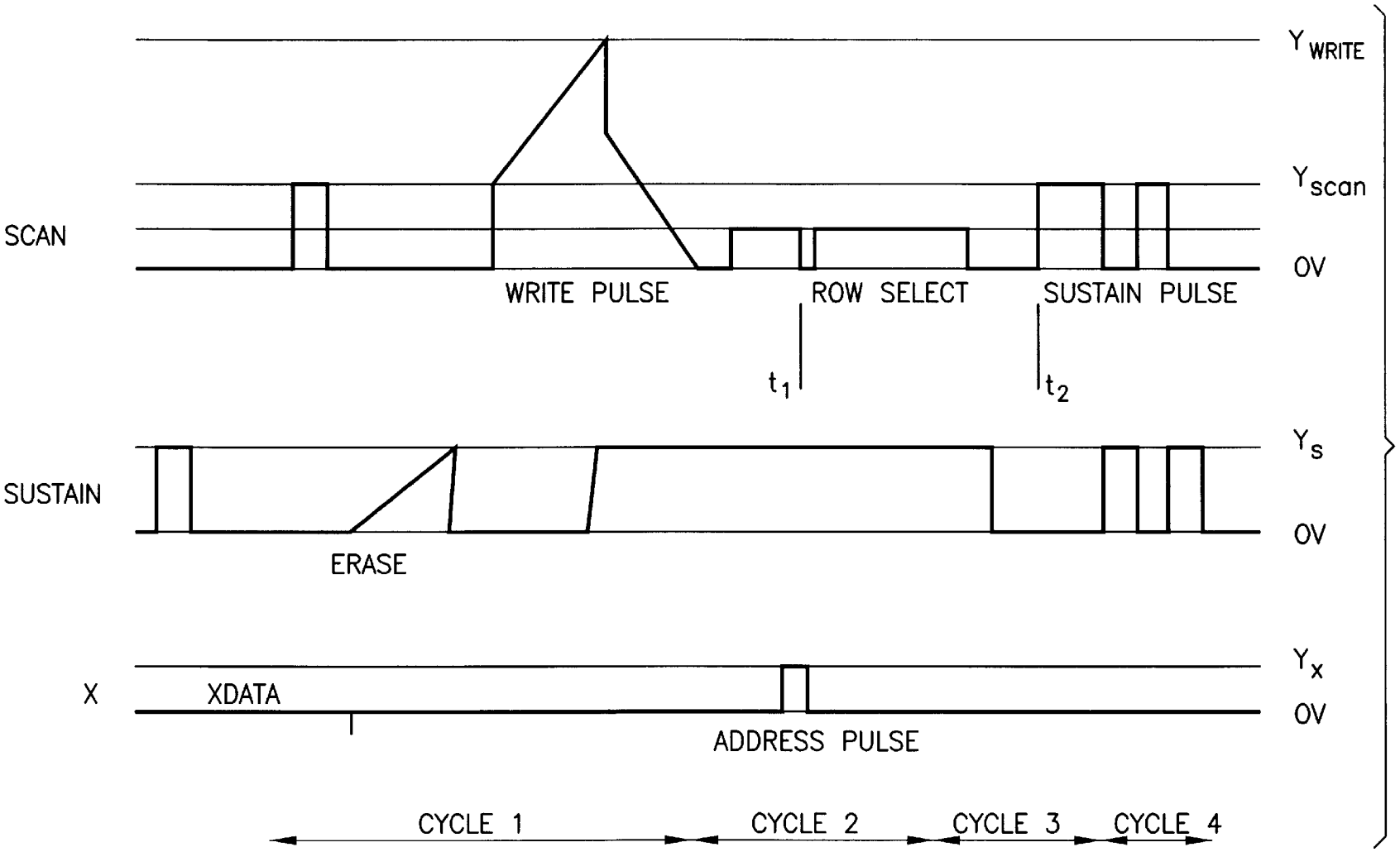
FIG. 4 is a set of waveform diagrams helpful in understanding the operation of the PDP of FIG. 3

Turning now to FIG. 4, a representative set of voltage waveforms is illustrated which enable operation of the PDP shown in FIG. 3. Initially, an erase pulse is applied to the sustain loops and erases each pixel site on the panel. Next, a write pulse is applied by scan generator 52 to all scan loops on the panel to cause a discharge to occur at each subpixel site. Thereafter, a high potential is applied to all sustain loops so that, in combination with a row select pulse applied to the scan loops and an address pulse applied to one or more column electrodes, a selective discharge of addressed subpixel sites is achieved. Thereafter, sustain signals are applied between the scan loops and sustain loops to achieve a continued discharge of the previously selected subpixel sites.

Contrast Enhancement Bars to Improve PDP Ambient Light Contrast Ratio

Referring back to FIG. 3, each addressed subpixel produces two discharge sites (e.g. 60, 62), one between each side of a scan loop and adjacent sustain loops. Light produced from these discharge sites is largely emitted through discharge gaps C. Within the loops, i.e., dimensions A and D, light is emitted, strongly, close to the respective traces and then diminishes quickly towards the center of the loop. To improve the contrast ratio of such a PDP structure, it has been found that positioning of opaque structures between traces of the loop electrodes blocks a substantial amount of reflected ambient light from the phosphor layer while not reducing the emitted light from the PDP by an unacceptable amount.

Figure 5:
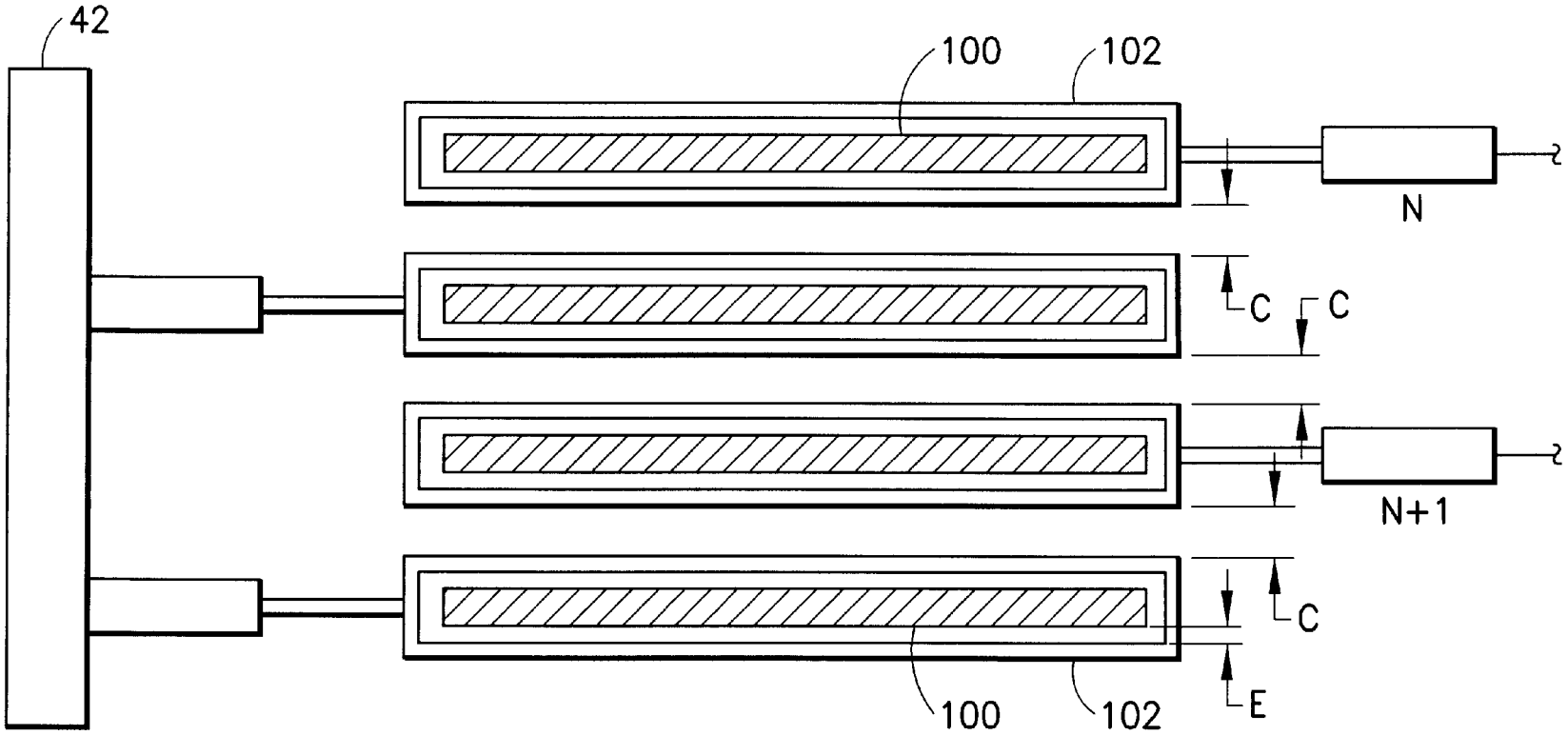
FIG. 5 illustrates a front plate electrode pattern that includes contrast enhancement bars.

FIG. 5 shows the same front plate topology as FIG. 3, with opaque structures 100 (hereafter referred to as "contrast enhancement bars") inserted between the traces that comprise each of electrode loops 102. Each edge of each contrast enhancement bar 100 is positioned a distance E from an adjoining trace of an electrode loop 102 so as not too restrict the strong light emission that occurs inside a respective electrode loop and close to the trace. Recall that the principal discharge takes place across the discharge gap (dimension C) between adjacent traces of juxtaposed sustain and scan loops. Accordingly, the principal light emission takes place across the discharge gap, with proportionally smaller light emissions emanating from within the respective loops 102.

It has been found that if dimension E is set to be in a range of about 0.5 to 1.0 times the discharge gap C, there is little diminution of emitted discharge light, while there is a substantial increase in ambient light contrast ratio of the PDP.

Figure 6A:
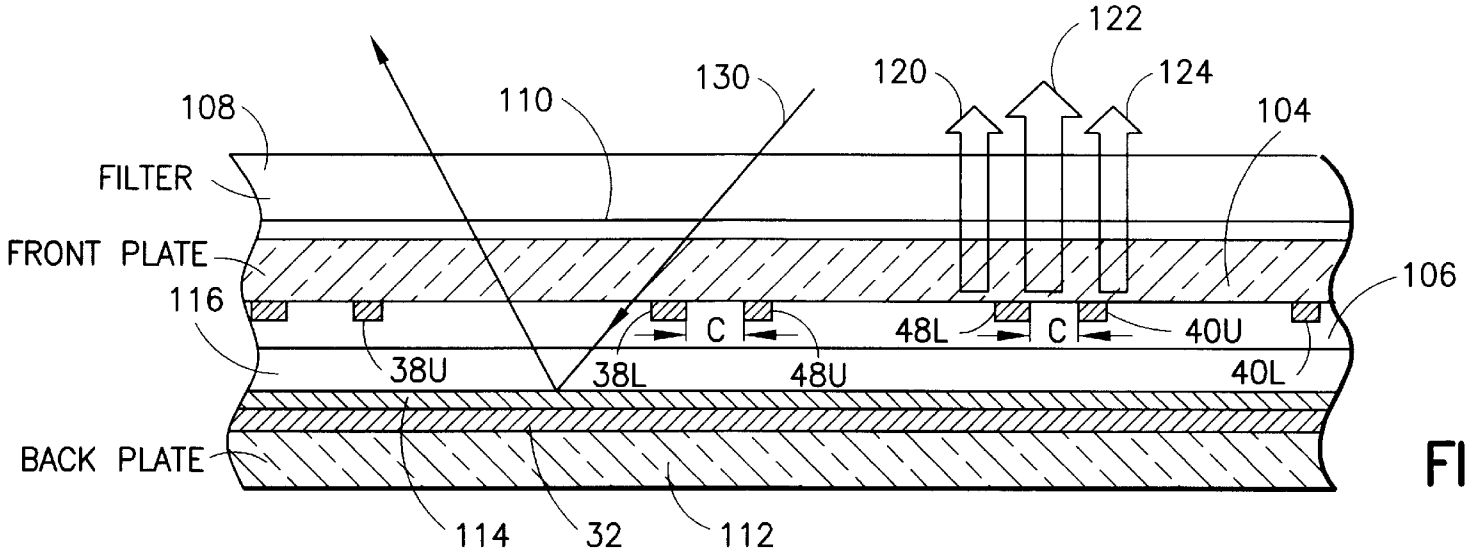
FIG. 6*a* is a sectional view of the PDP of FIG. 3 that does not include contrast enhancement bars.
Figure 6B:
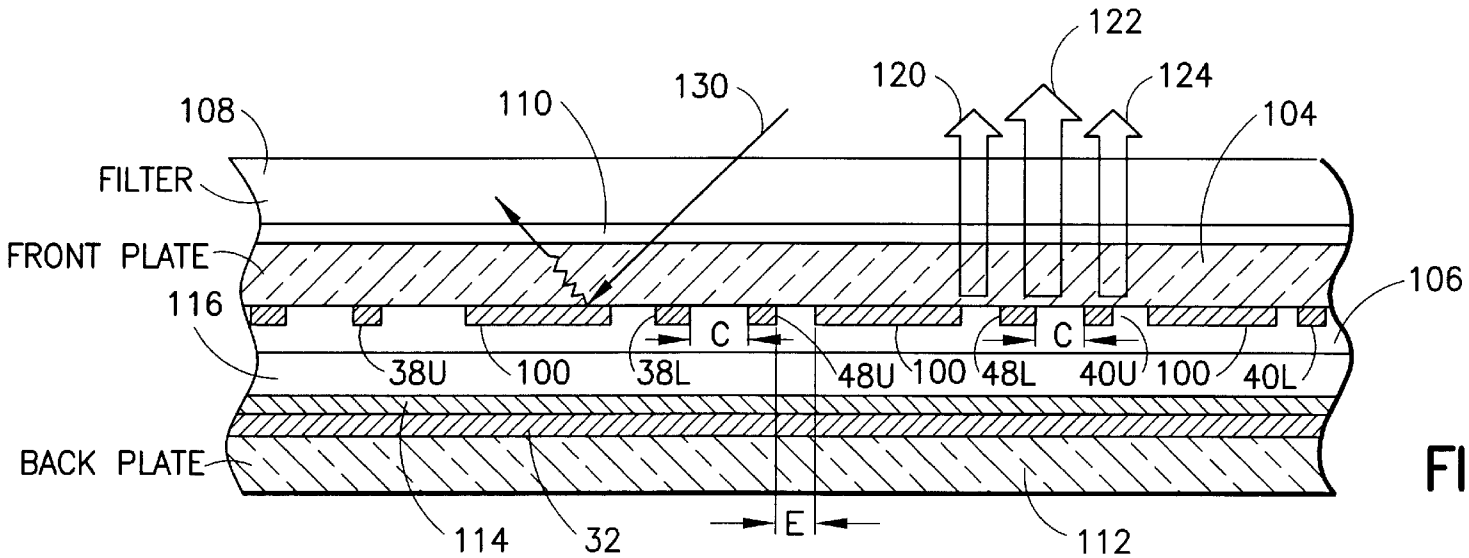
FIG. 6*b* is a sectional view of a PDP that includes contrast enhancement bars that improve image contrast in ambient light.

FIGS. 6*a* and 6*b* show cross sectional side views of the PDP of FIG. 3, with FIG. 6*a* illustrating a PDP without the contrast enhancement bars and FIG. 6*b* with the contrast enhancement bars. The PDP structures in both Figures are identical except for the presence of the contrast enhancement bars 100. Both Figures employ the element numbering found in FIG. 3.

Referring first to FIG. 6*a*, electrode loop traces 38U, 38L, 48U, 48L, 40U, 40L, etc. reside on front plate 104 and are covered by a dielectric layer 106. A filter 108 is separated from front plate 104 by an air gap 110. A back plate 112 supports a column electrode 32 that is covered by a phosphor layer 114. A dischargeable gas is present in substrate gap 116. Arrows 120, 122 and 124 illustrate the light that is given off at a discharge gap C between electrode traces 40U and 48L. As indicated above, most of the emitted discharge light travels along the path of arrow 122, while smaller proportions are emitted along arrows 120 and 124. Note, that there is no structure which blocks ambient light 130 from reflecting off phosphor layer 114 to reduce the contrast ratio of the PDP.

FIG. 6*b* illustrates the placement of contrast enhancement bars 100 within the respective electrode loops 102 to reduce the amount of ambient light 130 which reaches phosphor layer 114. Each edge of each contrast enhancement bar 100 is separated by dimension E from an an adjacent loop electrode trace. As dimension E allows a large proportion of the discharge light that is emitted within an electrode loop to pass, only a small part of the discharge light is blocked by a contrast enhancement bar 100 while a large percentage of ambient light is prevented from striking the phosphor.

In particular, when a subpixel site is addressed, wall charges are set up at each of the two discharge sites, which comprise the subpixel. Subsequent sustain cycles, produce discharges across each respective discharge gap C. The discharge forms at the edges of the discharge gap, and spreads out across the electrode traces on either side of the discharge gap. Since the electrode traces block the light from coming through front plate 104, the light produced is emitted through the discharge gap C or on the inside of the electrode loops. The light coming out on the loop side of the trace electrodes is most intense at the edge of the trace electrodes and quickly diminishes to scattered light at the center of the electrode loop.

The addition of a contrast enhancement bar within an electrode loop allows the intense light to be emitted through a discharge gap C and at the inside edges of the loop traces. The scattered light normally emitted from the electrode loop centers is either absorbed or reflected back to phosphor 114 by contrast enhancement bar 100.

The material used for contrast enhancement bars 100 is not critical. For instance, a PDP developed using this technology simply used the same electrode material as the loop electrodes (i.e. chrome/copper/chrome conductors). Such a contrast enhancement bar structure is convenient because it does not require any additional process or alignment steps, only a straightforward electrode mask change. To render the contrast enhancement bar more absorptive, the initial chrome layer deposited on the front panel may be subjected to an oxidation process to blacken its color. Farther, in lieu of a conductive contrast enhancement bar structure, a black glass layer may be screen printed on the front plate and utilized as the contrast enhancement bar structure.

The conductivity of the contrast enhancement bars is not a hindrance for performance. Since the addressing techniques control the wall charge on the pixel sites very precisely, little charge is placed on the contrast enhancement bars. Furthermore, the contrast enhancement bar is floating, i.e. not connected to the loop electrodes, so there isn't sufficient charge transfer from the loop trace electrode to couple discharges to a contrast enhancement bar. There is also a benefit to be gained from the conductivity of the contrast enhancement bars. During discharge activity, the contrast bars will accumulate a negative charge. Once charged negatively, when the surrounding loop rises in potential to become the anode of a discharge, the negative charge on the contrast enhancement bar is sufficient to repel the spreading discharge which is moving towards the positive voltage. This results in an improvement in cell to cell isolation.

As indicated above, since each contrast enhancement bar is semi-reflective and only obstructs scattered light, minimal brightness reduction occurs when the spacing E between the loop trace electrodes and the contrast enhancement bar is in a range of about 0.5 to 1.0 times the discharge gap distance C.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

I claim:

1. A color AC plasma display panel (PDP) comprising:

a) a first substrate having plural elongated address electrode structures including sets of color phosphors;

b) a second substrate in opposition to said first substrate and enclosing a dischargeable gas therebetween, said second substrate supporting i) a plurality of scan electrode structures orthogonally oriented to said address electrode structures, each scan electrode structure comprising a scan loop having a first elongated scan trace and a second elongated scan trace and ii) a plurality of sustain electrode structures in parallel configuration and interdigitated with said scan electrode structures, each sustain electrode structure comprising a sustain loop having a first elongated sustain trace and a second elongated sustain trace; and (iii) contrast enhancement bars positioned within plural ones of said scan loops and sustain loops and exhibiting a surface area which blocks a substantial proportion of ambient light incident upon an area within each loop from reaching and reflecting off said color phosphors.

2. The color AC PDP as recited in claim 1, wherein each edge of said contrast enhancement bar that is adjacent either a scan loop trace or a sustain loop trace is separated therefrom by a distance that is about 0.5 to 1.0 times an intertrace discharge distance between an adjacent scan trace and a sustain trace.

3. The color AC PDP as recited in claim 1, wherein each said contrast enhancement bar comprises a conductive electrode that is electrically isolated from a juxtaposed loop.

4. The color AC PDP as recited in claim 1, wherein each said contrast enhancement bar comprises a conductive electrode having a substantially non-reflective surface visible through said second substrate.

5. The color AC PDP as recited in claim 1, wherein each said contrast enhancement bar comprises an optically opaque, electrically isolated conductive electrode.

6. The color AC PDP as recited in claim 1, wherein each said contrast enhancement bar comprises an optically opaque, dielectric layer.

7. The color AC PDP as recited in claim 1, wherein each said set of color phosphors comprises red, green, and blue phosphors that are respectively positioned on sequences of said address electrode structures.

8. The color AC PDP as recited in claim 1, wherein a distance D between said first elongated scan trace and said second elongated scan trace of each of said scan electrode structures is less than a distance A between said first elongated sustain trace and said second elongated sustain trace of each of said sustain electrode structures.

9. An AC plasma display panel (PDP) comprising:

a) a first substrate having plural elongated address electrode structures with dielectric layers present thereon;

b) a second substrate in opposition to said first substrate and enclosing a dischargeable gas therebetween, said second substrate supporting i) a plurality of scan electrode structures orthogonally oriented to said address electrode structures, each scan electrode structure comprising a scan loop having a first elongated scan trace and a second elongated scan trace and ii) a plurality of sustain electrode structures in parallel configuration and interdigitated with said scan electrode structures, each sustain electrode structure comprising a sustain loop having a first elongated sustain trace and a second elongated sustain trace;

(iii) contrast enhancement bars positioned within plural ones of said scan loops and sustain loops and exhibiting a surface area which blocks a substantial proportion of ambient light incident upon an area within each loop from reaching and reflecting off said first substrate.

10. The AC PDP as recited in claim 9, wherein each edge of said contrast enhancement bar that is adjacent either a scan loop trace or a sustain loop trace is separated therefrom by a distance that is about 0.5 to 1.0 times an intertrace discharge distance between an adjacent scan trace and a sustain trace.

11. The AC PDP as recited in claim 9, wherein each of said contrast enhancement bars comprises a conductive electrode that is electrically isolated from a juxtaposed loop.

12. The AC PDP as recited in claim 9, wherein each of said contrast enhancement bars comprises an optically opaque, electrically isolated conductive electrode.

13. The AC PDP as recited in claim 9, wherein each of said contrast enhancement bars comprises an optically opaque, dielectric layer.

14. The AC PDP as recited in claim 9, wherein each of said contrast enhancement bars comprises a conductive electrode having a substantially non-reflective surface visible through said second substrate.

15. The AC PDP as recited in claim 9, wherein a distance D between said first elongated scan trace and said second elongated scan trace of each of said scan electrode structures is less than a distance A between said first elongated sustain trace and said second elongated sustain trace of each of said sustain electrode structures.

* * * * *